US009768570B2

(12) United States Patent
Petricek

(10) Patent No.: US 9,768,570 B2
(45) Date of Patent: Sep. 19, 2017

(54) ARRANGEMENT HAVING TWO ELECTRICAL DEVICES

(71) Applicant: Siemens Aktiengesellschaft, Munich (DE)

(72) Inventor: Martin Petricek, Hollabrunn (AT)

(73) Assignee: Siemens Aktiengesellshaft, Munich (DE)

( * ) Notice: Subject to any disclaimer, the term of this patent is extended or adjusted under 35 U.S.C. 154(b) by 0 days.

(21) Appl. No.: 15/025,100

(22) PCT Filed: Sep. 8, 2014

(86) PCT No.: PCT/EP2014/069064
§ 371 (c)(1),
(2) Date: Mar. 25, 2016

(87) PCT Pub. No.: WO2015/043937
PCT Pub. Date: Apr. 2, 2015

(65) Prior Publication Data

US 2016/0240988 A1 Aug. 18, 2016

(30) Foreign Application Priority Data

Sep. 26, 2013 (EP) ..... 13186130

(51) Int. Cl.
*H01R 13/627* (2006.01)
*H01R 31/02* (2006.01)
(Continued)

(52) U.S. Cl.
CPC ..... *H01R 31/02* (2013.01); *H01R 9/2458* (2013.01); *H01R 13/629* (2013.01); *H01R 13/6271* (2013.01)

(58) Field of Classification Search
CPC . H01R 4/4818; H01R 13/7032; H01R 13/193
(Continued)

(56) References Cited

U.S. PATENT DOCUMENTS 5,615,079 A * 3/1997 Eggert ..... H01R 9/2675 361/601
6,443,756 B1 9/2002 Hagmann et al.
(Continued)

FOREIGN PATENT DOCUMENTS

CN 1339186 3/2002
CN 1862883 11/2006
(Continued)

OTHER PUBLICATIONS

Office Action dated Mar. 23, 2017 which issued in the corresponding Chinese Patent Application No. 201480053152.6.

*Primary Examiner* — Abdullah Riyami
*Assistant Examiner* — Thang Nguyen
(74) *Attorney, Agent, or Firm* — Cozen O'Connor

(57) ABSTRACT

An arrangement having two electronic devices which are each surrounded by a dedicated device housing and mounted side-by-side, wherein each electronic device has at least one electrical contact for electrically connecting the two devices, and a connecting plug with mating contacts and with a plug housing is provided, where each dedicated device housing has formed sections which are held in position in relation to one another, when the devices are mounted, via mating formed sections which are arranged on the plug housing, and where the contacts of the two devices are connected by means of the mating contacts such that rapid assembly is firstly allowed in one working step and such that the contacts cannot be loosened or become detached by changes in the position of the devices is secondly assured.

13 Claims, 6 Drawing Sheets

(51) Int. Cl.
*H01R 9/24* (2006.01)
*H01R 13/629* (2006.01)

(58) Field of Classification Search
USPC ..... 439/268, 441, 362, 341, 353, 507
See application file for complete search history.

(56) References Cited

U.S. PATENT DOCUMENTS

| | | | | |
|---|---|---|---|---|
| 6,663,441 | B1 * | 12/2003 | Alexandre | H01R 4/4827 439/715 |
| 7,232,324 | B2 * | 6/2007 | Oesterhaus | H01R 4/4827 439/268 |
| 7,713,072 | B2 * | 5/2010 | Azzola | H01H 71/08 439/119 |
| 7,959,474 | B2 * | 6/2011 | Beyer | H01R 9/2466 439/712 |
| 8,987,619 | B2 * | 3/2015 | Bodenmeier | H01R 9/2416 200/50.28 |
| 2010/0159720 | A1 * | 6/2010 | Wang | H01R 13/447 439/76.1 |
| 2010/0248556 | A1 * | 9/2010 | De Carolis | H01R 9/2408 439/717 |

FOREIGN PATENT DOCUMENTS

| | | | |
|---|---|---|---|
| CN | 101764307 | | 6/2010 |
| CN | 102918720 | | 2/2013 |
| EP | 1129509 | | 10/2002 |
| EP | 1715547 | A2 | 10/2006 |
| EP | 2093787 | | 8/2009 |
| EP | 2093787 | A1 | 8/2009 |

* cited by examiner

ARRANGEMENT HAVING TWO ELECTRICAL DEVICES

CROSS-REFERENCE TO RELATED APPLICATIONS

This is a U.S. national stage of application No. PCT/EP2014/069064 filed 8 Sep. 2014. Priority is claimed on European Application No. 13186130.4 filed 26 Sep. 2014, the content of which is incorporated herein by reference in its entirety.

BACKGROUND OF THE INVENTION

1. Field of the Invention

The invention relates to a method and an arrangement having two electronic devices, which are each enclosed by a dedicated device housing and mounted side-by-side, where each device has at least one electrical contact for electrically connecting the two devices.

2. Description of the Related Art

Electrical installations, in particular in the field of automation engineering, usually comprise a plurality of electrical or electronic devices arranged inside a control cabinet. In these installations, there is often the need to connect electrically to one another two devices mounted side-by-side on a top-hat rail. For this purpose, it is standard practice to take an electrical contact to the outside of a device housing for each device.

Electrical contacts in the form of terminals and connected to one another by a plug-in jumper are known, for example, for providing the connection. A known alternative to this is to connect such terminals using a slack cable, giving more flexibility in positioning the devices.

Devices are also known that have a flexible connecting cable, which is taken out of the device housing and has a connecting plug. In order to connect to another device, this connecting plug is plugged into a corresponding socket of the other device.

SUMMARY OF THE INVENTION

It is therefore, an object of the invention to provide an improved arrangement having two electronic devices and a method for installing the electronic devices.

These and other objects and advantages are achieved a in accordance with the invention by a method and arrangement in which a connector having mating contacts and a connector housing is provided, where each device housing has shaped segments which, in the installed state, are held in position relative to one another via mating shaped segments arranged on the connector housing, and where the contacts of the two devices are connected via the mating contacts. This not only allows rapid installation in one operation but also ensures that the contacts cannot work loose or become detached by changes in the position of the devices.

In an embodiment of the invention, at least one electronic device comprises a plurality of electrical contacts, which are combined into a socket or a built-in plug, where the connector has corresponding mating contacts, which are combined into a plug or socket element. Rapid and reliable installation is thereby also provided for a plurality of contacts or for multipole contacts.

It is advantageous if at least one mating shaped segment of the connector housing is shaped as a hook or is hook-shaped and, in the installed state, is snap-fitted in a ventilation cutout of a device housing. Device housings usually already have ventilation slots, which can thereby be used for a robust, interlocking connection to the connector. Special shaped segments on the device housing are not necessary.

In one embodiment of the invention, in the installed state, the connector housing is connected to each device housing via a snap-fitted plug-in connection. The connector is then removable and is only placed onto the devices when a device connection is required.

In an alternative embodiment, the connector housing is connected to one device housing by a hinge joint, and the connector housing is connected to the other device housing via a snap-fitted plug-in connection. In this case, the connector is fixed to one device housing, and therefore a connection to another device is readily possible. Hence, this dispenses with the logistical arrangements that must be made for an unattached connector. In addition, it dispenses with one plug-in connection, because the electrical connections of the connector to the permanently connected devices are made as permanent electrical contacts. Here, it is advantageous if a plug or socket element is spring-loaded in the connector housing. Arranged within the plug or socket element is one mating contact or a plurality of mating contacts. During installation, this plug or socket element is guided over the contact or contacts of the device to be connected, making a reliable contact.

In an advantageous embodiment, the connector housing, in the installed state, covers the contacts of the devices and the mating contacts of the connector in a shockproof manner. Additional shockproof protection of the connection is no longer necessary.

It is also advantageous if both electronic devices are power supplies. Particularly with power supplies there is often the need to connect devices mounted side-by-side on a top-hat rail to one another. Thus, for instance, higher powers can be output by connecting a plurality of standard devices. In addition, it is thereby possible to combine a plurality of power supplies for the redundant supply of a load. In this case, status data is transferred via the electrical connection between the devices in order to ensure, in the event of a device failure, that the supply is maintained by the other device. The presently disclosed embodiments in accordance with the invention thus allows power supplies to be used in industrial installations in a particularly flexible and scalable manner.

It is also an object of the invention to provide a method for installing the arrangement where, in a single action to install the connector, the shaped segments of the device housing are connected to the mating shaped segments of the connector housing, and the contacts of the device are connected to the mating contacts of the connector. This not only saves time but also ensures by virtue of the connection of the shaped segments and mating shaped segments that the correct electrical contacts are connected to one another.

In an embodiment of the method, the connector is hinged via a hinged joint, which connects the connector to one device, over the at least one contact of the other device, and in the process a plug or socket element, which is spring-loaded in the connector housing, is connected in the contact-making direction to the at least one contact. In this method, the positioning of the connector is already defined, and therefore the device connection can be made by a simple folding action.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is described below by way of example with reference to the accompanying figures, in which, using a schematic diagram, in which.

DETAILED DESCRIPTION OF THE EXEMPLARY EMBODIMENTS

Figure 1:
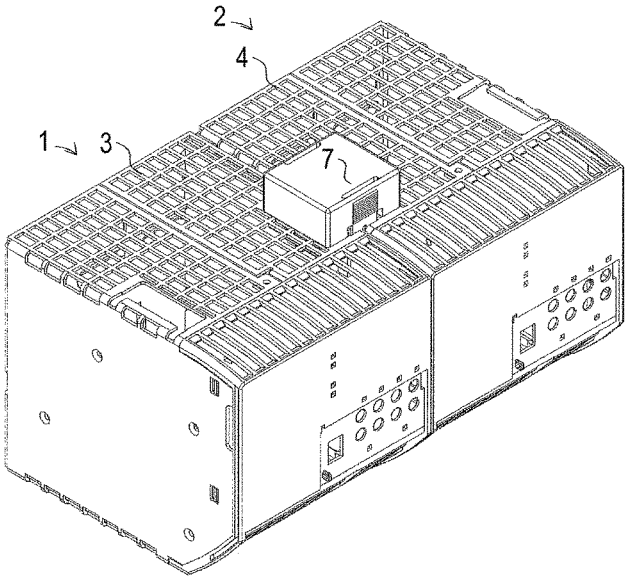
FIG. 1 shows two devices with a plugged in connector in accordance with the invention.
Figure 2:
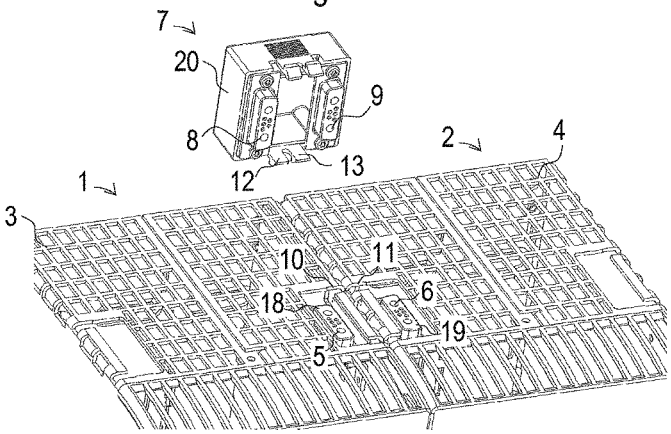
FIG. 2 shows two devices with the connector removed in accordance with the invention.
Figure 3:
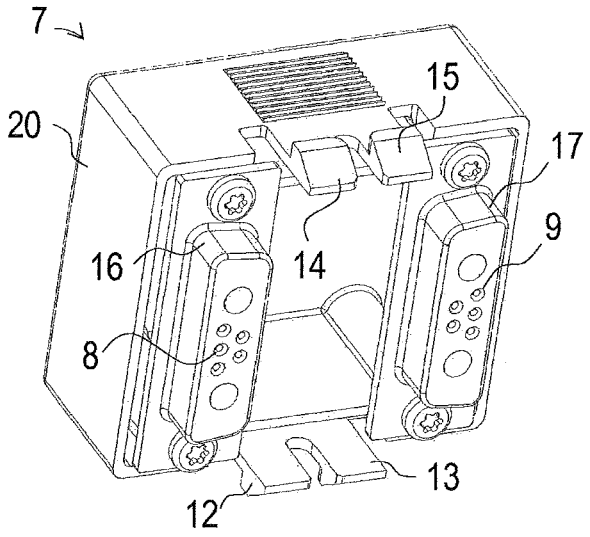
FIG. 3 shows a connector for plugging into both devices in accordance with the invention.
Figure 4:
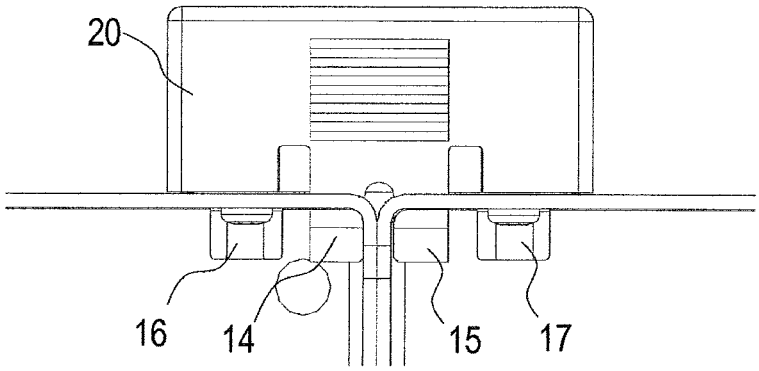
FIG. 4 shows a detailed view of the plugged-in connector in accordance with the invention.
Figure 5:
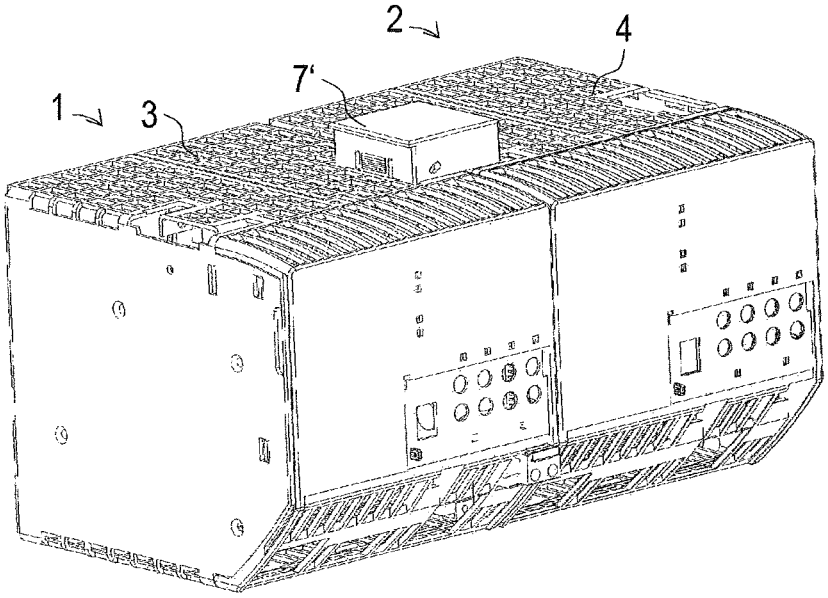
FIG. 5 shows two devices having a hinged connector in accordance with the invention.
Figure 6:
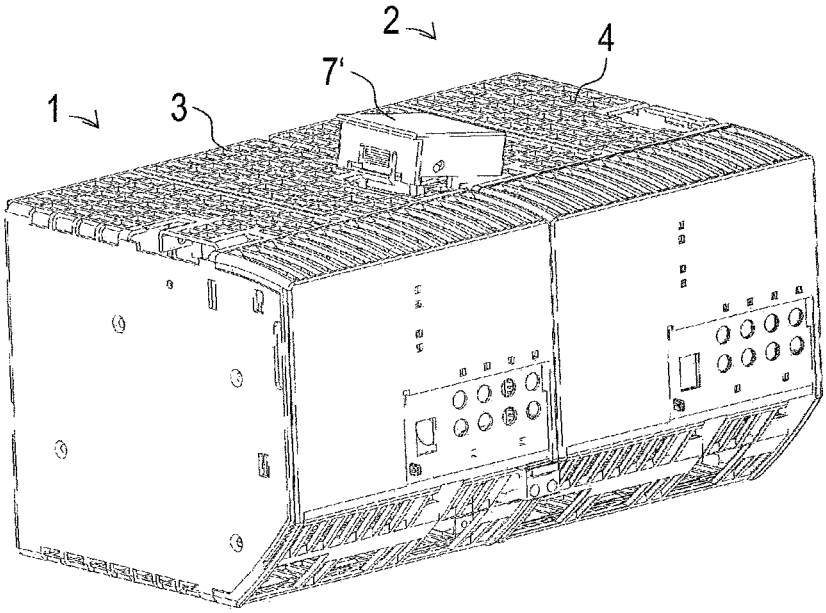
FIG. 6 shows two devices with a connector partially hinged-open in accordance with the invention.
Figure 7:
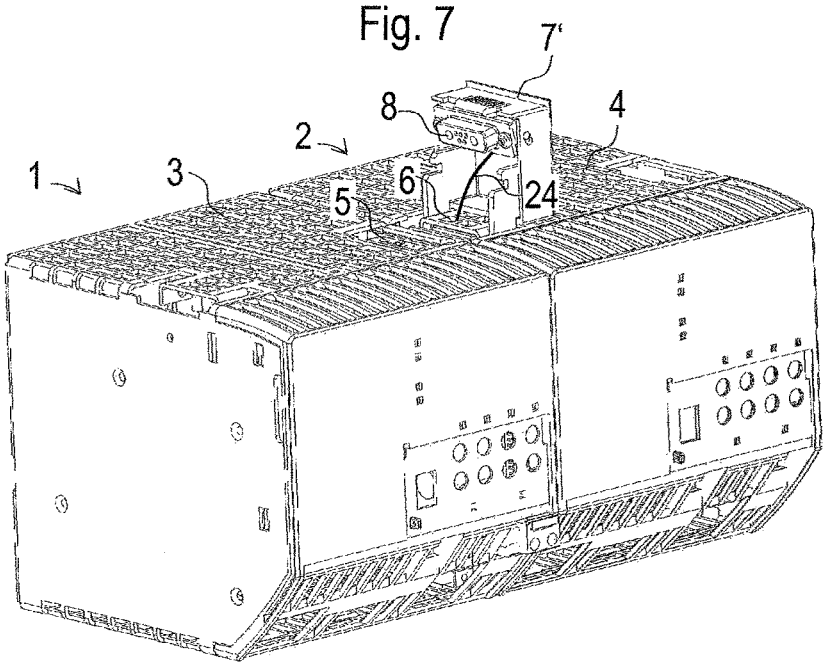
FIG. 7 shows two devices with a connector fully hinged-open in accordance with the invention.
Figure 8:
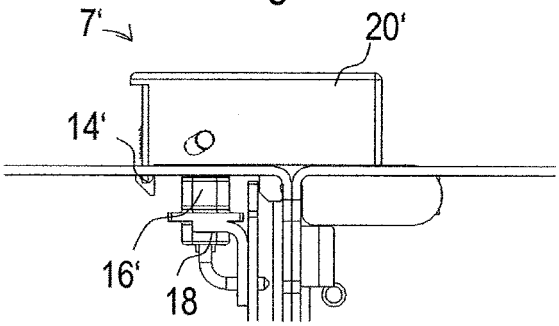
FIG. 8 shows a hinged connector in the installed state in accordance with the invention.
Figure 9:
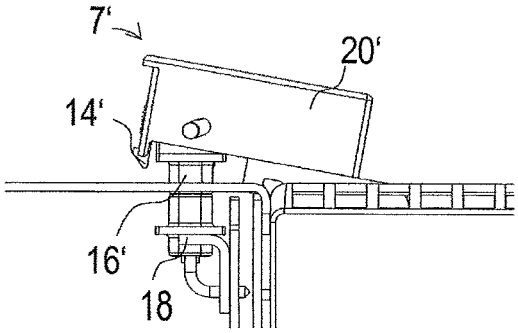
FIG. 9 shows a hinged connector in the partially hinged-open state in accordance with the invention.
Figure 10:
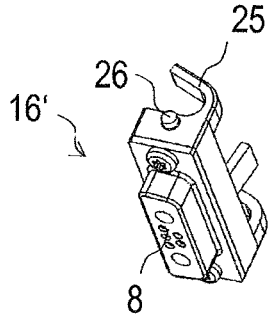
FIG. 10 shows a spring-loaded plug or socket element in accordance with the invention.
Figure 11:
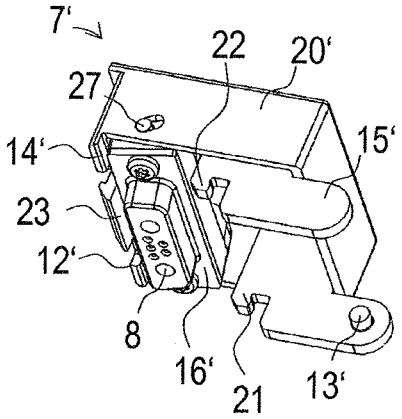
FIG. 11 shows a hinged connector having a spring-loaded plug or socket element in the hinged-open position in accordance with the invention.
Figure 12:
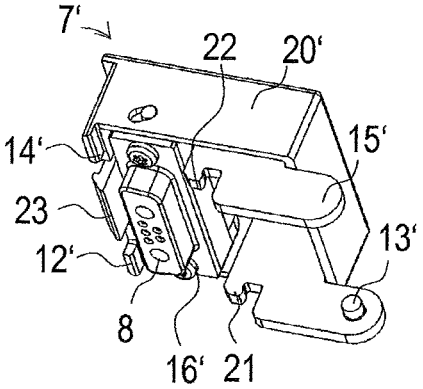
FIG. 12 shows a hinged connector having a spring-loaded plug socket element in the installed position in accordance with the invention.

FIGS. 1 and 2 show two devices 1, 2 mounted side-by-side. In FIG. 1, these devices 1, 2 are connected on the topside of the respective device housings 3, 4 by a connector 7. FIGS. 3 and 4 show detailed views of this connector 7.

FIG. 2 shows the same arrangement with connector 7 unplugged. The two devices 1, 2 are advantageously mounted side-by-side on a top-hat rail (not shown), with the result that the position of the contacts 5, 6 to be connected of the two devices 1, 2 is already predetermined. The connector 7 is installed using a single plug-in action. In this process, the contacts 5, 6 are electrically connected to one another via mating contacts 8, 9 of the connector 7. Simultaneously, shaped segments 10, 11 of the two device housings 3, 4 are connected to one another via mating shaped segments 12, 13, 14, 15 of the connector 7, whereby the two devices 1, 2 are held in position relative to one another. Mechanical forces acting on the devices 1, 2 are absorbed by this interlocking connection, with the result that the connection of the contacts 5, 6 to the mating contacts 8, 9 is not subject to mechanical stresses.

Ventilation slots that are needed anyway are advantageously used as the shaped segments 10, 11 of the device housing 3, 4. Hook-shaped mating shaped segments 12, 13, 14, 15 of the connector 7 snap-fit into these slots. The hook-shaped mating shaped segments 12, 13, 14, 15 are elastically deformable, so that they can be moved manually out of the latched position to disconnect the connection.

Where there are a plurality of contacts 5, 6 to be connected, it is advantageous to combine these contacts into one socket or one built-in plug 18, 19 respectively. The mating contacts 8, 9 are then combined into one matching plug or socket element 16, 17 respectively.

The mating contacts 8, 9 are electrically connected to one another inside a connector housing 20 with the result that when connector 7 is in the installed state, the electrical connection of the contacts 5, 6 of the two devices 1, 2 is made.

FIGS. 5 to 12 show an alternative embodiment of the device connection. In this embodiment, a device 2 is connected to the connector 7' via a hinge. The device 2 has corresponding shaped segments, which together with the mating shaped segments 13', 15' of the connector 7' form this hinge. The connector 7' is hinged about a hinge axis, whereby at least one contact 5 of the other device 1 can be connected to a mating contact 8.

A contact 6 of the device 2 connected to the connector 7' by the hinge is advantageously permanently connected to the mating contact 8 of the connector 7' via a flexible electrical connection 24. Thus only one detachable connection of one contact 5 or a plurality of contacts 5 to one mating contact 8 or a plurality of mating contacts 8 is used to make the contact between the two devices 1, 2. This reduces the risks of contact not being made as a result of faulty plug-in contacts.

The contact 5 or contacts 5 of the device 1 to be connected is/are advantageously formed as a socket or as a built-in plug 18. As the mating part, the mating contact 8 or a plurality of mating contacts 8 is/are formed as a plug or socket element 16'. This plug or socket element 16' is spring-loaded in the connector housing 20', in this case. For this purpose, the plug or socket element 16' has elastic extensions 25, which are held against the inside wall of the connector housing 20'. In addition, pins 26 are arranged on each side and are carried in elongated slots 27 in the connector housing 20'. The plug or socket element 16' is thereby positioned during tilting of the connector 7' initially exactly over the contact 5 or contacts 5 of the device 1 to be connected. Subsequently, by virtue of guidance in the connector housing 20', the plug or socket element 16' performs a linear movement in the plug-in direction. The guidance thus ensures that the tilting movement of the connector 7' results in the plug or socket element 16' moving in a straight line. This ensures that a skewed movement cannot occur during the process of making contact between the device contact 5 and the mating contact 8. Such skewed movement could result in damage to the contacts 5, 8.

As soon as the connector 7' is hinged onto the device 1 to be connected, a plurality of mating shaped segments 12', 14', 21, 22, 23 engage in corresponding shaped segments of the device housing 3, thereby providing secure positioning of the two devices 1, 2 relative to one another. Here, it is again advantageous if ventilation slots are used as the shaped segments of the device housing 3.

For purposes of simplicity, the built-in plugs or sockets 18, 19 shown in the figures and the corresponding plug or socket elements 16, 16', 17 are neutral, i.e., shown neither as male contacts nor as female contacts. In fact, one contact 5, 6 always has a female configuration design and the corresponding mating contact 8, 9 has a male configuration, or vice versa.

Figure 13:
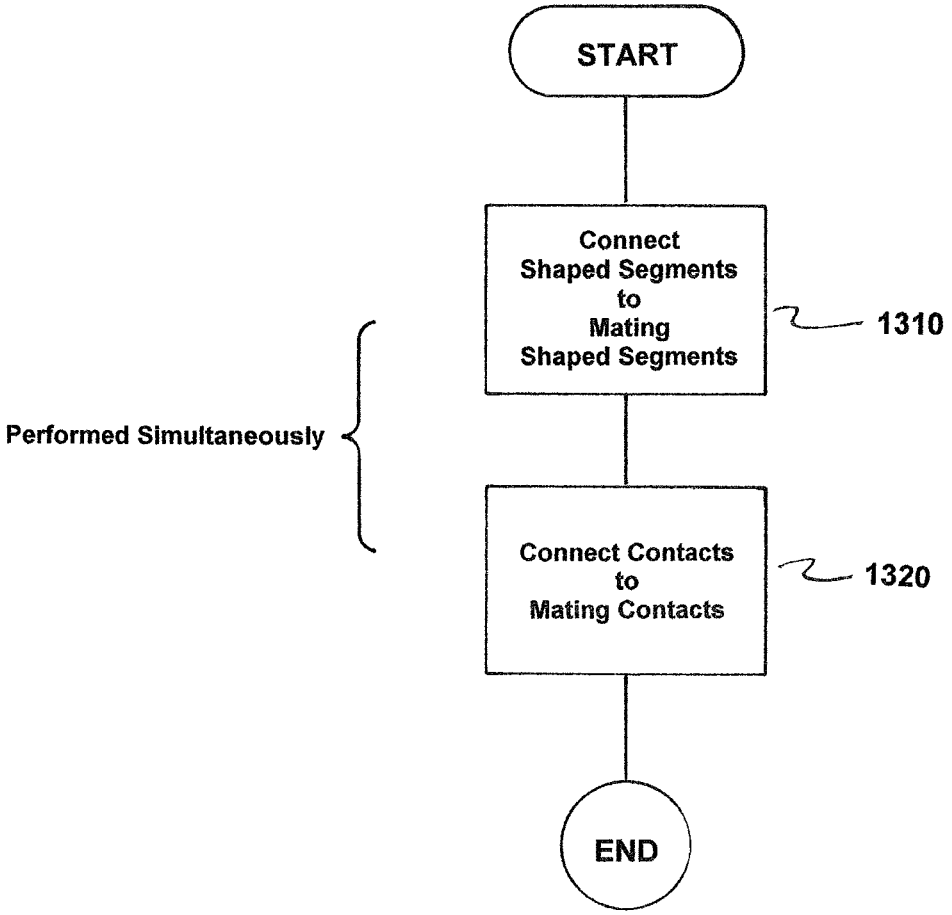
FIG. 13 is a flowchart of the method in accordance with the invention.

FIG. 13 is a flowchart of a method for installing an arrangement including a dedicated device housing (3, 4), two electronic devices (1, 2) enclosed by a respective dedicated device housing (3, 4) and mounted side-by-side, where each of the two devices (1, 2) include at least one electrical contact (5, 6) for electrically connecting the two electronic devices (1, 2), a connector (7, 7') having mating contacts (8, 9), a connector housing (20, 20'), and mating shaped segments (12, 12', 13, 13', 14, 14', 15, 15', 21, 22, 23) arranged on the connector housing (20, 20'). In addition, each dedicated device housing (3, 4) includes shaped segments (10, 11) which, in an installed state, are held in position relative to one another via the mating shaped segments (12, 12', 13, 13', 14, 14', 15, 15', 21, 22, 23) arranged on the connector housing (20, 20'), and the at least one contact (5, 6) of each of the two electronic devices (1, 2) are connected via the mating contacts (8, 9).

The method, via a single action to install the connector (7, 7'), comprises connecting the shaped segments (10, 11) of the device housing (3, 4) to the mating shaped segments (12, 12', 13, 13', 14, 14', 15, 15', 21, 22, 23) of the connector housing (20, 20') (step 1310) and connecting the contacts (5, 6) of the device (1, 2) to the mating contacts (8, 9) of the connector (7, 7') (step 1320).

While there have been shown, described and pointed out fundamental novel features of the invention as applied to a preferred embodiment thereof, it will be understood that various omissions and substitutions and changes in the form and details of the methods described and the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An arrangement comprising:

a dedicated device housing;

two electronic devices enclosed by a respective dedicated device housing and mounted side-by-side, each of the two devices including at least one electrical contact for electrically connecting the two electronic devices;

a connector having mating contacts;

a connector housing;

mating shaped segments arranged on the connector housing;

and a plug or socket element, which is spring-loaded in the connector housing;

wherein each dedicated device housing includes shaped segments which, in an installed state;

are held in position relative to one another via the mating shaped segments arranged on the connector housing;

and wherein the at least one contact of each of the two electronic devices is connected via the mating contacts.

2. The arrangement as claimed in claim 1, wherein at least one electronic device of the two electronic devices comprises a plurality of electrical contacts, which are combined into the socket or a built-in plug; and wherein the connector includes corresponding mating contacts which are combined into the plug or socket element.

3. The arrangement as claimed in claim 1, wherein at least one mating shaped segment of the connector housing is hook-shaped and, in the installed state, is snap-fitted in a ventilation cutout of the dedicated device housing.

4. The arrangement as claimed in claim 2, wherein at least one mating shaped segment of the connector housing is shaped as a hook and, in the installed state, is snap-fitted in a ventilation cutout of the dedicated device housing.

5. The arrangement as claimed in claim 1, wherein, in the installed state, the connector housing is connected to each respective dedicated device housing via a snap-fitted plug-in connection.

6. The arrangement as claimed in claim 2, wherein, in the installed state, the connector housing is connected to each respective dedicated device housing via a snap-fitted plug-in connection.

7. The arrangement as claimed in claim 3, wherein, in the installed state, the connector housing is connected to each respective dedicated device housing via a snap-fitted plug-in connection.

8. The arrangement as claimed in claim 1, wherein the connector housing is connected to one dedicated device housing by a hinged joint; and wherein the connector housing is connected to another dedicated device housing via a snap-fitted plug-in connection.

9. The arrangement as claimed in claim 2, wherein the connector housing is connected to one dedicated device housing by a hinged joint; and wherein the connector housing is connected to another dedicated device housing via a snap-fitted plug-in connection.

10. The arrangement as claimed in claim 3, wherein the connector housing is connected to one dedicated device housing by a hinged joint; and wherein the connector housing is connected to another dedicated device housing via a snap-fitted plug-in connection.

11. The arrangement as claimed in claim 1, wherein the connector housing, in the installed state, covers the plurality of electrical contacts of the two devices and mating contacts of the connector in a shockproof manner.

12. The arrangement as claimed in claim 1, wherein both of the two electronic devices are power supplies.

13. A method for installing an arrangement including a dedicated device housing, two electronic devices enclosed by a respective dedicated device housing and mounted side-by-side, each of the two devices including at least one electrical contact for electrically connecting the two electronic devices, a connector having mating contacts, a connector housing, and mating shaped segments arranged on the connector housing, each dedicated device housing including shaped segments which, in an installed state, are held in position relative to one another via the mating shaped segments arranged on the connector housing, and the at least one contact of each of the two electronic devices being connected via the mating contacts, the method, via a single action to install the connector, comprising:

connecting the shaped segments of the device housing to the mating shaped segments of the connector housing; and connecting the contacts of the device to the mating contacts of the connector;

wherein the connector is hinged via a hinged joint, which connects the connector to one electronic device of the two electronic devices, over the at least one contact of another electronic device of the two electronic devices; and wherein, during the single action, a plug or socket element, which is spring-loaded in the connector housing, is connected in the contact-making direction to the at least one contact.

* * * * *